US005383416A

United States Patent [19]

Henz et al.

[11] Patent Number: 5,383,416

[45] Date of Patent: Jan. 24, 1995

[54] THREAD CLAMPING AND CUTTING APPARATUS FOR THE REAR OR LOWER THREAD OF AN EMBROIDERING MACHINE

[75] Inventors: Jürg Henz, Romanshorn; Max Schreiber; Armin Kobler, both of Arbon, all of Germany; Karl W. Wiest, Götzis, Austria; Livio Selm, Berg, Germany

[73] Assignee: Saurer Sticksysteme, Arbon, Switzerland

[21] Appl. No.: 946,280

[22] Filed: Sep. 17, 1992

[30] Foreign Application Priority Data

Nov. 8, 1991 [DE] Germany ..... 9113900[U]
Feb. 1, 1992 [DE] Germany ..... 4202891

[51] Int. Cl.[6] ..... D05B 65/00

[52] U.S. Cl. ..... 112/298; 112/194; 112/301

[58] Field of Search ..... 112/80.55, 80.7, 80.71, 112/285, 288, 291, 292, 295, 296, 298, 194, 195, 80.56, 164, 184, 232, 234

[56] References Cited

U.S. PATENT DOCUMENTS

| | | | |
|---|---|---|---|
| 1,816,308 | 7/1931 | Allen | 112/296 |
| 2,345,943 | 4/1944 | McCann | 112/296 |
| 3,118,405 | 1/1964 | Schenkengel | 112/296 |
| 3,701,329 | 10/1972 | Olney, Jr. | 112/296 |
| 3,760,749 | 9/1973 | Trageser | 112/296 |
| 4,558,654 | 12/1985 | Schilling et al. | 112/298 |

FOREIGN PATENT DOCUMENTS

| | | | |
|---|---|---|---|
| 0468892 | 1/1992 | European Pat. Off. . | |
| 226828 | 5/1909 | Germany . | |
| 243879 | 4/1911 | Germany . | |
| 258911 | 5/1912 | Germany . | |
| 289806 | 4/1914 | Germany . | |
| 1485498 | 4/1969 | Germany . | |
| 2065264 | 2/1973 | Germany | 112/296 |
| 2347305 | 3/1974 | Germany . | |
| 2344720 | 4/1975 | Germany . | |
| 2743727 | 4/1978 | Germany . | |
| 3023159 | 1/1981 | Germany . | |
| 3124795 | 11/1982 | Germany . | |
| 3133333 | 3/1983 | Germany . | |
| 3239130 | 4/1984 | Germany . | |
| 3737423 | 5/1988 | Germany . | |
| 3744401 | 7/1988 | Germany . | |
| 9003911 | 8/1990 | Germany . | |
| 0044957 | 9/1987 | Japan | 112/285 |

OTHER PUBLICATIONS

Von Heinrich Kühne, "Alles über Fadenabschneider," Dürkopp-Fadenabschneider der Baureihe 15 000, Sep. 1977, pp. 38 and 43.

*Primary Examiner*—Clifford D. Crowder
*Assistant Examiner*—Ismael Izaguirre
*Attorney, Agent, or Firm*—Keck, Mahin & Cate

[57] ABSTRACT

A device for clamping and cutting the rear or lower thread in an embroidering machine having a stitch plate with a stitch hole, a shuttle guide and a shuttle displaceably mounted in the shuttle guide. The clamping and cutting device which are arranged in the region of the stitch hole include a thread cutting device having a cutting blade and a thread clamping device having a thread clamping gap. The cutting device conveys the rear or lower thread into the clamping gap of the clamping device, where the thread is clamped before being cut. The cutting device does not take part in the clamping of said thread. Subsequent movements of the cutting device do not affect already clamped threads.

12 Claims, 7 Drawing Sheets

THREAD CLAMPING AND CUTTING APPARATUS FOR THE REAR OR LOWER THREAD OF AN EMBROIDERING MACHINE

BACKGROUND OF THE INVENTION

This invention relates to apparatus for clamping and cutting the rear or lower thread in an embroidery machine having a stitch plate having a stitch hole, a shuttle guide, a shuttle displaceably mounted in the shuttle guide, a slidable thread clamping device and a thread cutting device. Such a machine is disclosed, for example in German patent specification No. 20 65 264, which is incorporated herein by reference.

In that machine a thread clamping and cutting device associated with each shuttle of the machine is driven so as to be displaceable by a rotary mechanism, vertically with respect to the conveying direction of the shuttle.

Each thread clamping and cutting device must have its own individual drive mechanism, in order to ensure separate control thereof, such separate drives being uneconomical of space. Such an arrangement can not be used in a conventional shuttle embroidering machine having a 4/4 ratio, because the space needed for the separate drives is unavailable.

Also, the length of the cut thread is such that the appearance of the embroidery is impaired on the reverse side of the embroidered material and the consumption of thread is unduly high.

Further, the clamping and cutting device is arranged in the region of the shuttle guide, whereby the path of the rear or lower thread is impaired, especially since the known clamping and cutting device penetrates the shuttle carrier.

In the known machine the cutting blade of the cutting device, itself initiates clamping of the thread, and the clamping of the thread depends directly upon the cutting process itself. Thus after the cutting of the rear or lower thread has bean completed, the thread is clamped between a clamping surface of a plate spring and the cutting blade itself. Thus when a new cutting operation is to be carried out the clamping of the thread is stopped and the cut rear or lower thread is released. At embroidery sites which are put out of operation on the needle side, the severed and free-hanging rear or lower thread runs up and down with the shuttle and so is rubbed. Thus, when such an embroidery site is operated again, breakage of the thread or dropped stitches may occur.

SUMMARY OF THE INVENTION

The present invention is intended to provide an embroidering machine with thread clamping and cutting apparatus enabling switching of the embroidery site on the needle side, which is initiated manually or mechanically, without accompanying rubbing of the idle rear or lower thread on the shuttle side.

According to the present invention, the cutting device is constructed in the form of the cutting blade with the cutting edge independently of the thread clamping device of the rear or lower thread. The thread clamping and cutting apparatus is arranged in the region of the stitch hole and in extension of the cutting device for the cutting blade a clamping gap of the thread clamping device. The thread, previously clamped by the cutting device and subsequently cut, is engaged and fixed in the clamping gap lying behind in the cutting direction.

A feature of the present invention is that clamping is carried out independently of the cutting of the rear or lower thread.

The clamping of the thread is independent of the movement of the cutting blade of the cutting device. In the prior art described above the cutting blade is, at the same time, the clamping element, whereby the rear or lower thread is released, as described above.

Since the thread is clamped independently of the cutting process, all the shuttle threads are cut off and are then transported into a clamping device which operates independently of the cutting process, where they are secured, even when the cutting blade returns again and carries out a further cutting process.

Thus the cut rear or lower thread is in any case secured in the clamping device and cannot be released by a cutting blade which is subsequently moved.

The rear or lower thread can then only be released from the clamping device by a corresponding pull on the rear or lower thread, when upon re-embroidering of the corresponding embroidery site the rear or lower thread is bound into the front thread and the pull on the rear or lower thread is sufficient to draw the thread out of the clamping site.

It is thereby ensured that where an idle embroidery site, is disconnected on the needle side, the shuttle, as it moves to an fro, can not damage and rub through the clamped rear or lower thread.

It is known to stop the shuttle drive, in order to avoid damage to the rear or lower thread.

In the case of the present invention there need be only a very small space on the shuttle side for the cutting and clamping apparatus, because no individual drive for each cutting and cutting device is needed. All the cutting devices can be actuated in parallel jointly and simultaneously via a common operating bar.

According to a preferred form of embodiment of the present invention the cutting blade itself is used as an operating element for the initiation of the clamping process. The cutting blade brings the rear or lower thread into the clamping device cut it and leaves it there. Thus when the cutting blade is retracted again, the rear or lower thread remains in the clamping device and is not released therefrom by return movement of the cutting blade.

According to a second embodiment, the clamping process, which is initiated independently of the cutting process, is initiated by its own operating element, which can be moved independently of the cutting blade. This operating element therefore takes up the cut off rear or lower thread and brings it into a corresponding clamping device, wherein it is secured.

For economy of space, the movement of the cutting blade may be parallel to that of the shuttle, the cutting and clamping mechanism being integrated in the stitch hole plate, which is connected to the shuttle carrier.

In the preferred embodiment of the present invention, the clamping device is located in the immediate vicinity of the cutting device, the cutting edge of the cutting device being in approximate alignment with a part of the clamping device. It is thereby ensured that the clamping and cutting of the thread takes place at the shortest possible distance.

The thread cutting and clamping apparatus should lie approximately in alignment with, and opposite to, the stitch hole in the stitch plate, it being likewise ensured that the cut off rear or lower thread is only of short length. The remainder of the rear or lower thread remaining on the embroidered material is thereby very short.

Since the cutting blade is located approximately in alignment with, and opposite to, the thread clamping device, the cutting element need only perform a very short cutting stroke, in order to cut off the rear or lower thread as specified.

Since the entire thread clamping and cutting device is located in the stitch plate, economy of space is achieved and access is provided to a drive part on the stitch plate, which takes over the drive for the thread clamping and cutting device.

In the preferred embodiment of the present invention, the thread clamping device is fixed and the cutting blade is guided so as to be movable in the stitch plate. Both parts are mounted in a corresponding sliding guide of the stitch plate so as to be exchangeable either entirely or in part.

DETAILED DESCRIPTION OF THE PREFERRED EMBODIMENT

Figure 1:
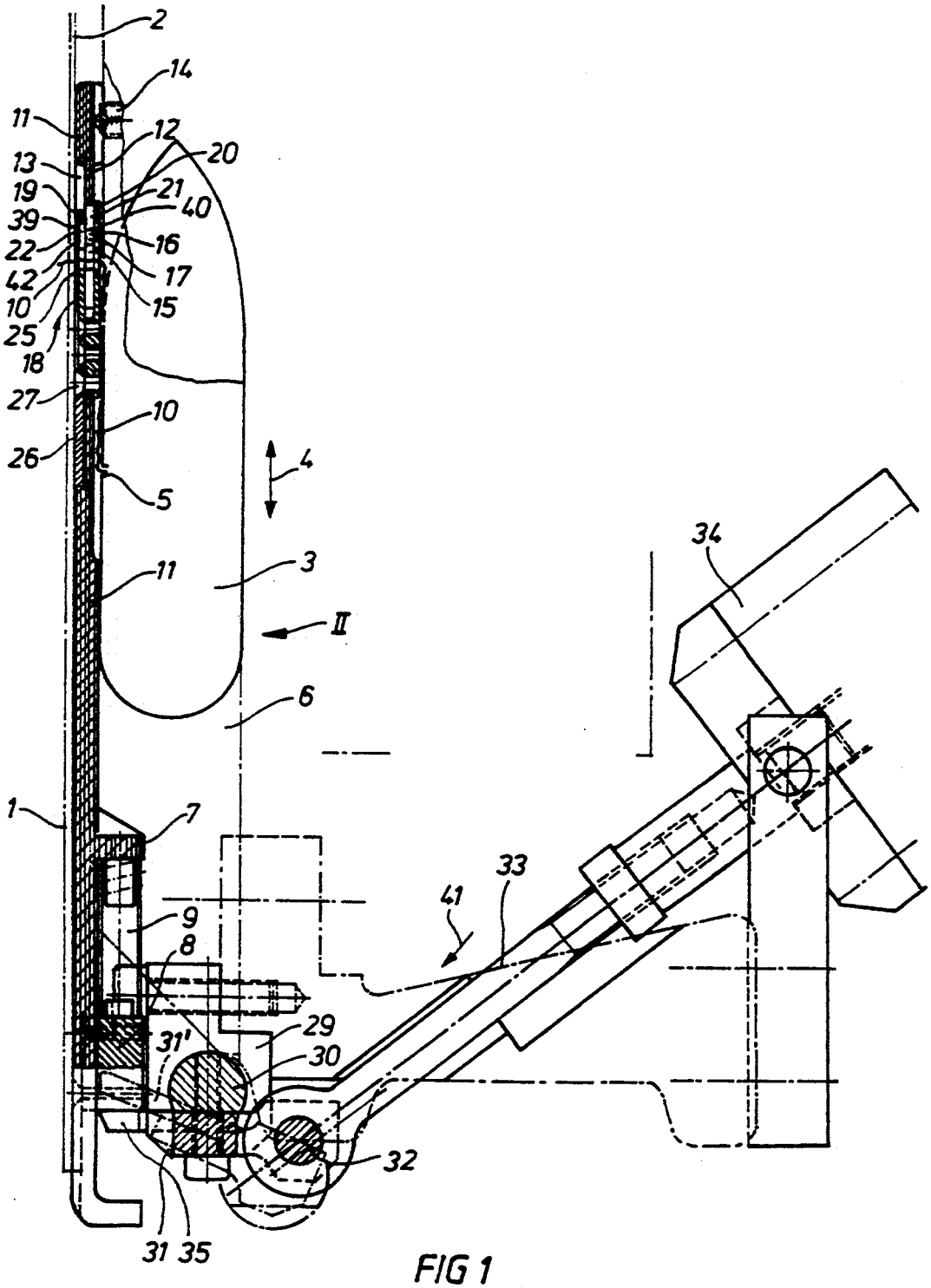
FIG. 1 is a sectional view taken on the lines I—I in FIG. 2, through a stitch plate of an embroidering station, according to the preferred embodiment of the invention.

FIG. 1 shows one of a plurality of stitch plates 2 along one surface of which a web of material 1 is guided in parallel with said surface. Each stitch plate 2 extends over several embroidery sites, for example over four embroidery sites, and has thereon shuttle guides 6, 6*a* and 6*b* for respective shuttles 3.

Figure 2:
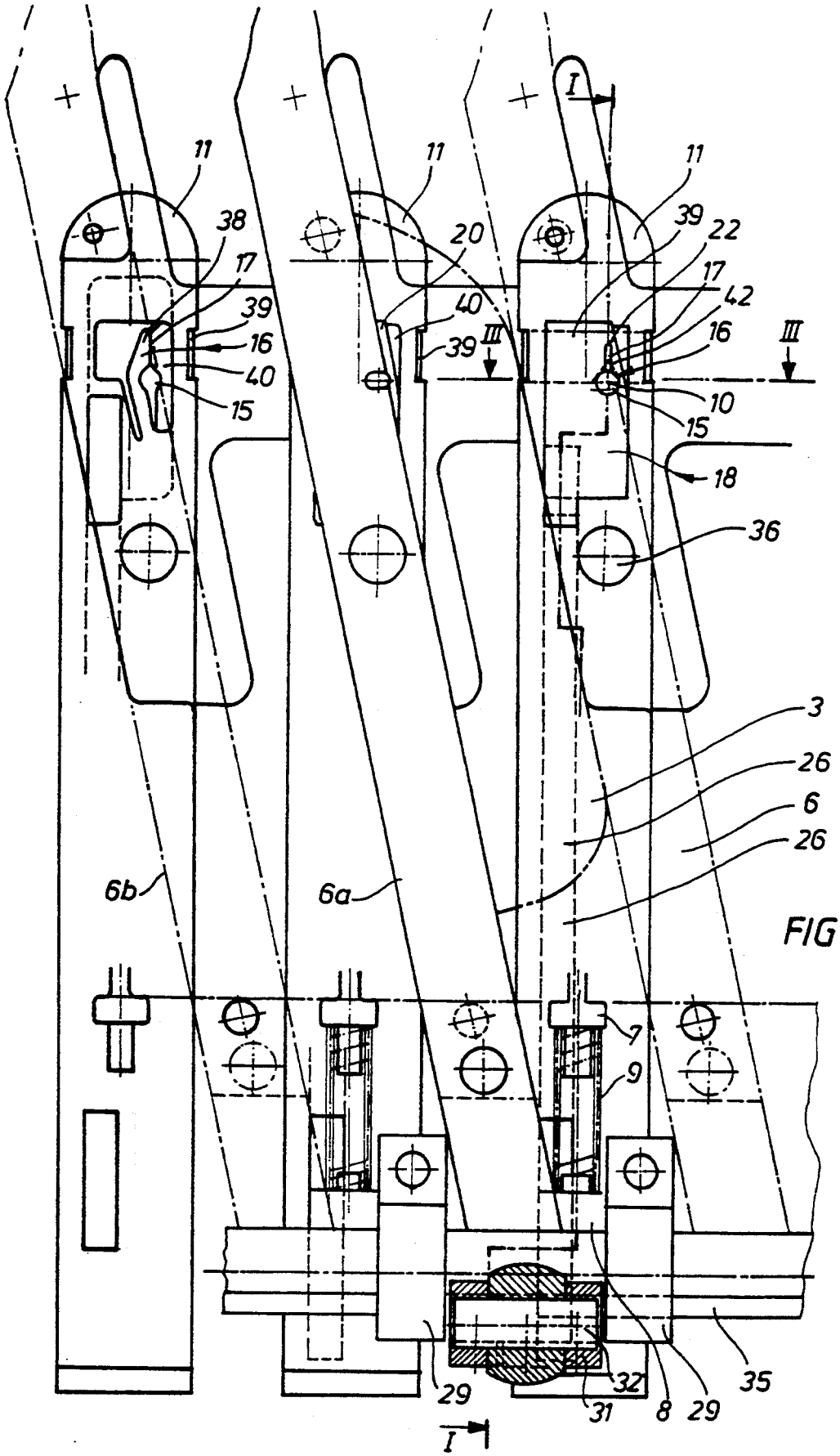
FIG. 2 is a side view taken in the direction of the arrow II in FIG. 1 showing three different shuttle guides.

Each shuttle guide 6, 6*a* and 6*b* is constructed as a half-open channel, in which said respective shuttle 3 is moved by means of a sliding drive (not shown in detail). The shuttle guides 6, 6*a* and 6*b* extend obliquely on the stitch plate 2 as shown in FIG. 2. Each shuttle 3 is driven slidably in the direction of the arrow 4 in FIG. 1 in its respective shuttle guide.

Figure 4:
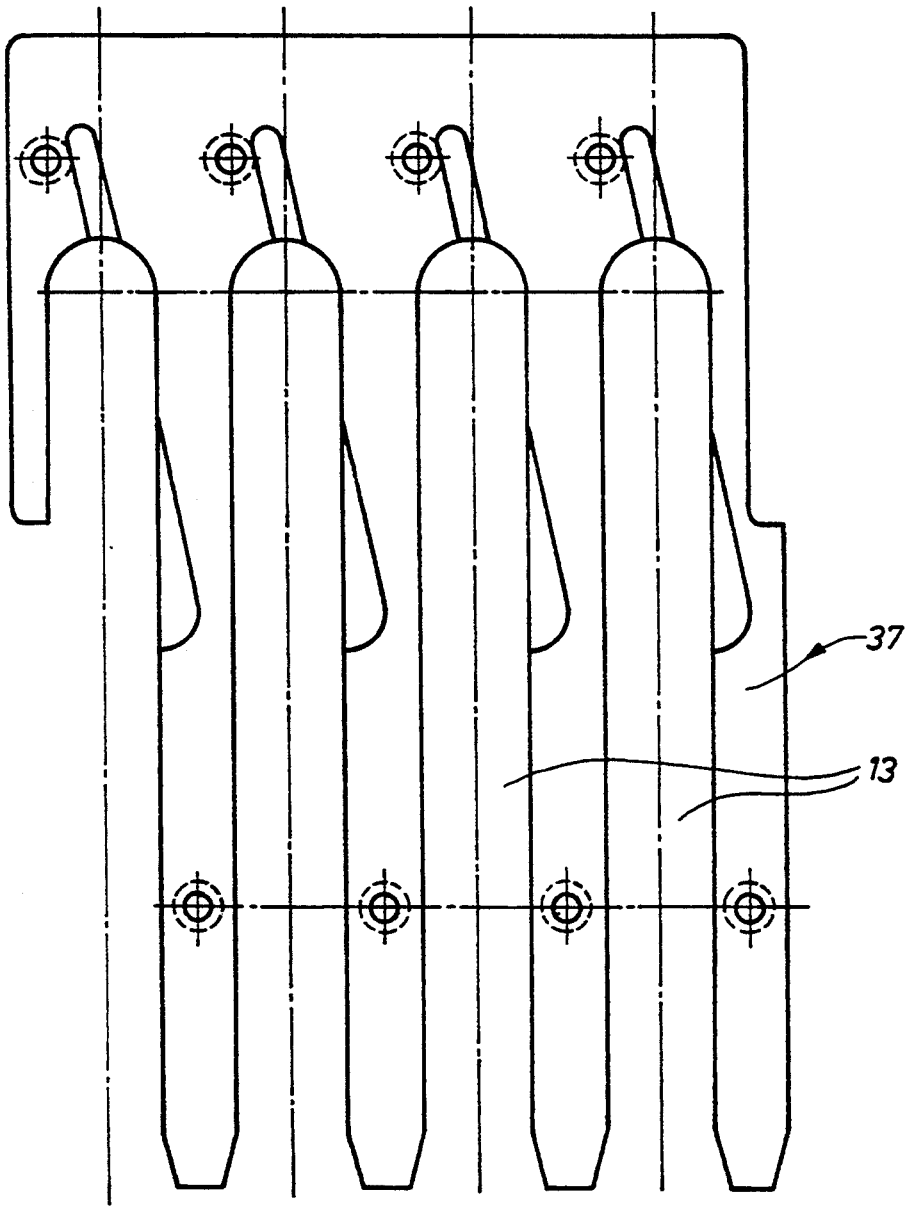
FIG. 4 is a plan view of an intermediate plate of the embroidering station.
Figure 4A:
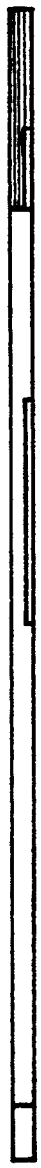
FIG. 4*a* is an end view of the intermediate plate.
Figures 5, 6:
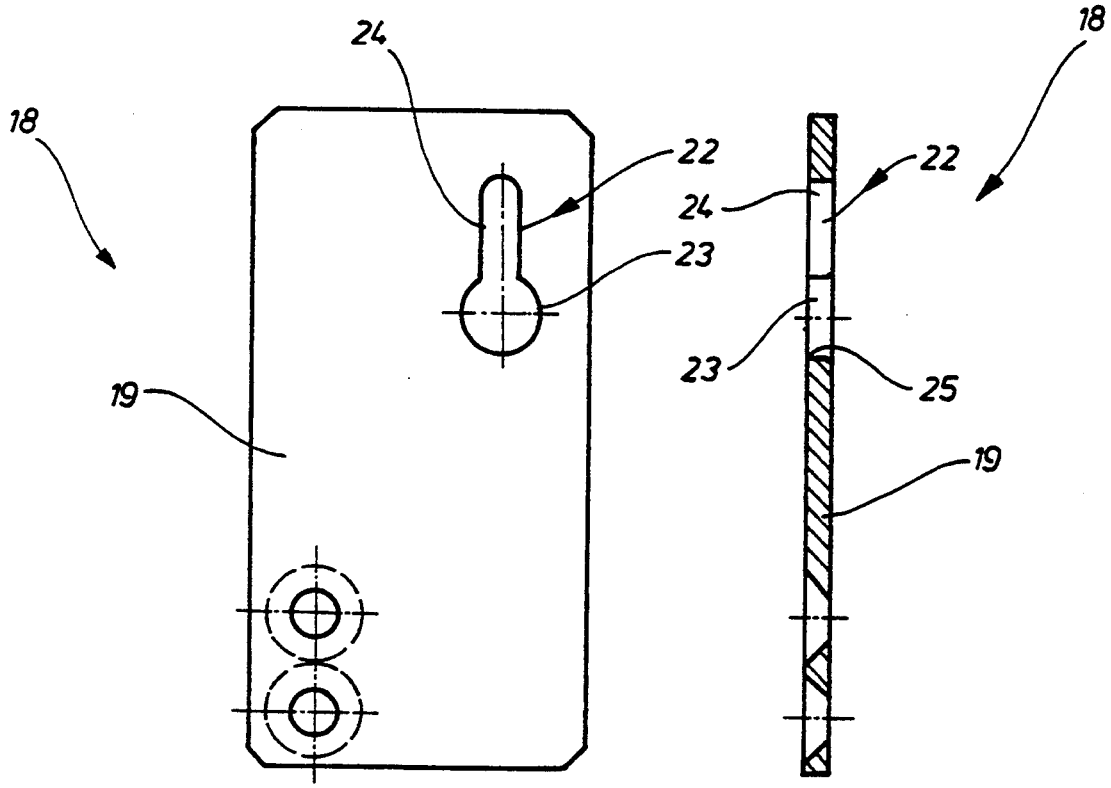
FIG. 5 is a plan view of a front plate of an operating slider of the embroidering station.
FIG. 6 is a sectional view through the front plate of FIG. 5.

There is attached to each stitch plate 2 an intermediate plate 37 (FIG. 4), in which are formed recesses 13 for respective guide parts 11. The guide parts 11, which are preferably plastic parts, are held detachably in the recesses 13 so that they can be dismantled. The recesses 13 are, as shown in FIG. 4, in the form of elongate holes, each open on one side to receive a respective guide plastic part 11, pushed thereinto.

As shown in FIG. 1 each plastic part 11 is held by means of a detent mounting 14 in the respective intermediate plate 37 and in the stitch plate 2. The entire guide part 11 can thereby be simply withdrawn from the intermediate plate 37.

Each guide part 11 has an inner recess 21, in which is slidably guided an operating slider 18. The operating slider is shown in further detail in FIG. 1, and in FIG. 2 on the right hand side of that Figure. The operating slider 18 comprises an operating bar 26, having at its lower end an extension 8, opposite which is an extension 7 located on the guide part 11. Between the extensions 7 and 8 a spring 9 is provided. By the action of the spring 9, therefore, the operating slider 18 is held in an inferior or lowered position, as shown in FIG. 1.

A piston-and-cylinder drive unit 34 is provided for slidably driving the operating bar 26 and thus the entire operating slider 18. The drive unit 34 acts via a piston rod 33 on a pivot pin 32, of a lever 31 mounted for swivelling movement. The lever 31 is connected to a shaft 30 so as to be secure with respect to rotation. The shaft 30 extends longitudinally over a particular number of embroidery sites.

When the piston rod 33 of the unit 34 is driven in sudden bursts, for example, in the direction of the arrow 41 in FIG. 1, the lever 31 swivels in a clockwise direction into a position 31′ and thereby lifts the extension 8 upwards against the action of the spring 9, whereby the entire operating rod 26 is displaced upwards in the direction of the arrow 4 in FIG. 1.

The operating slider 18 is connected by means of screws 27 to the operating bar 26. The operating slider 18 forms a U-shaped part, which as shown in FIGS. 5 to 8 consists substantially of a front plate 19 referred to as the cutting device and of a rear plate 20. The plates 19 and 20 are spaced from each other to define a recess 21 (FIG. 1) into which engages a corresponding extension 12 of the guide part 11. Straight guidance of the operating slider 18 is thereby ensured in the region of the guide part 11.

A keyhole-shaped recess 22 in the front plate 19 comprises a bore 23, the upper part of which communicates with an elongate hole 24. As will appear from FIG. 6, the left hand portion of the lower rim of the bore 23 is formed as a thread cutting edge 25, whereas the remainder of said lower rim is rounded and so does not act as a cutting edge thereby protecting the thread.

Figure 7:
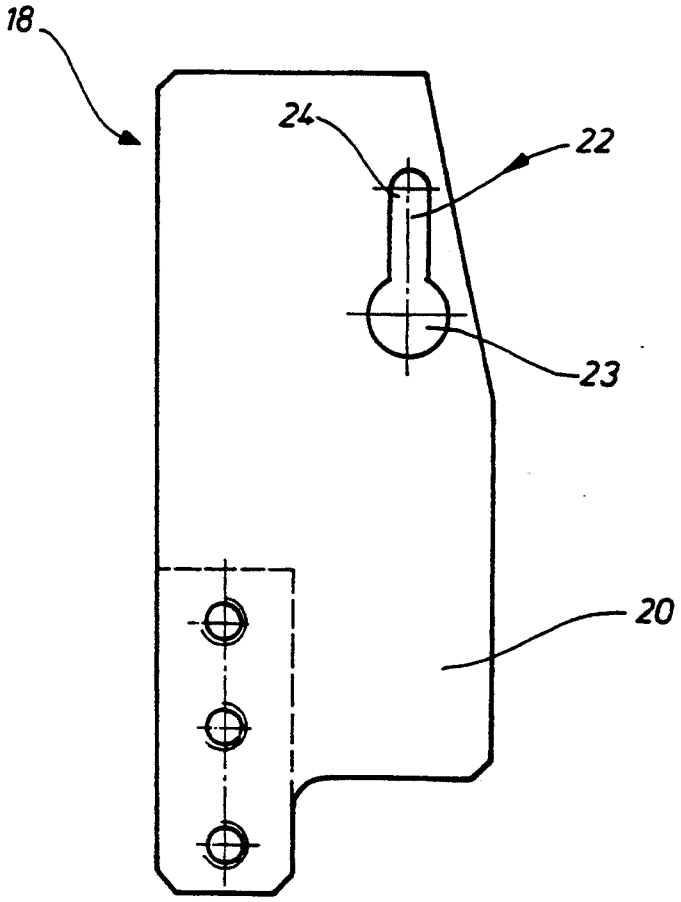
FIG. 7 is a plan view of a rear plate of the operating slider.
Figure 8:
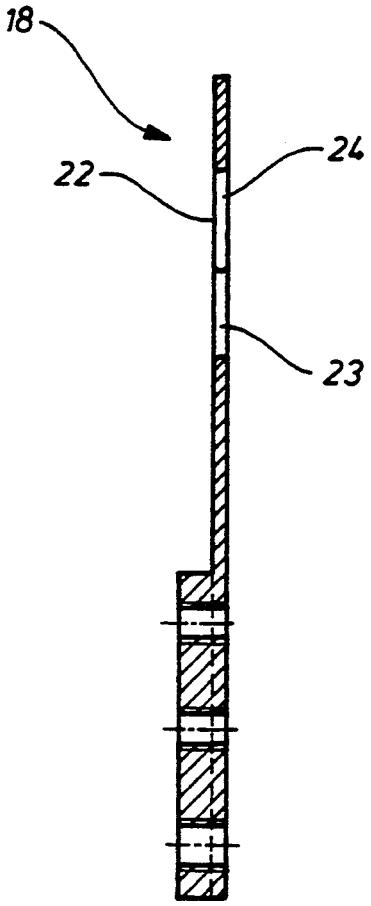
FIG. 8 is a sectional view of the rear plate of FIG. 7.

In alignment with, and opposite to, the keyhole-shaped recess 22 in the front plate 19, is an identical keyhole-shaped recess 22 in the rear plate 20, as shown in FIGS. 7 and 8. The whole of the lower rim of the bore 23 of the rear plate 20 is, however, non-cutting, being rounded so that it cannot damage the thread, as are all the other edges of said rim.

A metal counter blade 39 having a V-shaped cutting edge 42, is engaged in each guide part 11, so as to be fixed and non-displaceable, but, nevertheless, so as to be easily interchangeable.

In the non-cutting position, the bores 23 of the operating slider 18 lie opposite to, and in exact alignment with, the stitch hole 15 in the stitch plate 2.

Figure 1A:
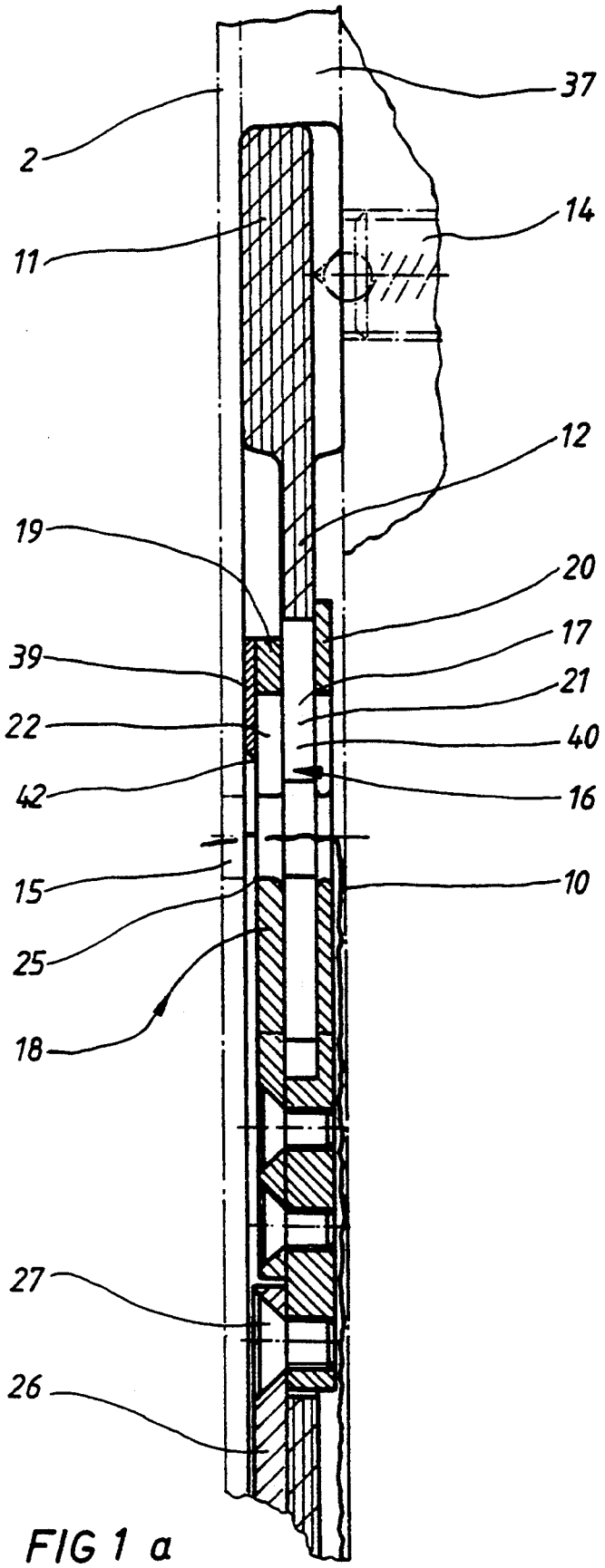
FIG. 1*a* is an enlarged sectional view through the stitch plate in the region of a stitch hole.

A preferably one-piece thread clamping finger 38 of a thread clamping device 16 is elastically mounted on one side in the plastics guide part 11. A clamping gap 17 being provided by the finger 38 in cooperation with a counter clamping piece 40 inserted in the guide part 11 (FIGS. 1, 1*a* and 2).

The clamping gap 17 must lie in the direction of movement of the operating slider 18 and, therefore, in the longitudinal direction of the shuttle guide,that is to say in the direction of the arrow 4, the clamping gap 17 extending upwards from the stitch hole 15.

As shown in the right hand part of FIG. 2 and in FIG. 1 the apex of the V-shaped cutting edge 42 of the counter blade 39 lies in the central region of the clamping gap 17.

Figure 3:
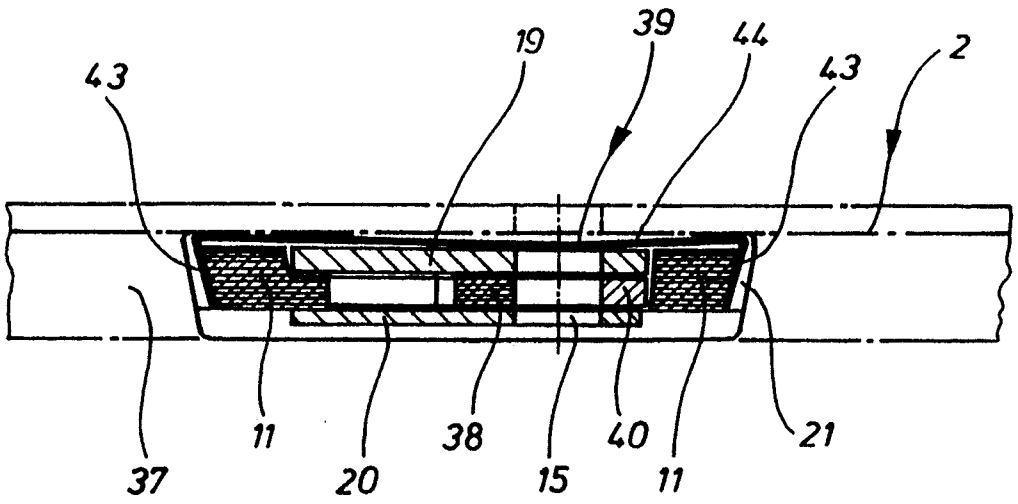
FIG. 3 is a sectional view taken on the lines III—III in FIG. 2 through a thread clamping and cutting device.

As shown in FIG. 3, the counter blade 39 has an approximately C-shaped profile, the two lateral shanks 43 of the blade 39 being clipped onto the lateral faces of the guide part 11.

By virtue of said C-shaped profile and since the clipped on shanks 43 are directed obliquely inwards, the front face 44 of the blade 39 curves inwards and so fits against the boundaries of the bores of the stitch hole 15. It is thereby ensured that the cutting front face 44 of the counter blade 39 lies closely and in a form-fitting manner against the hole 23 in the front plate 19.

As shown in FIG. 3 the plates 19 and 20 of the slider 18, which are connected together, are guided in the region of the guide piece 11, and within the recess 21, counter clamping piece 40 being located between the plates 19 and 20. The clamping finger 38 is located on the opposite side of the thread hole 15.

A thread clamping and cutting process carried out by means of the structure described above will now be described in detail.

As will be apparent from FIG. 1, the rear or lower thread 10 is withdrawn from the thread hole 5 in the shuttle 3 and runs through the stitch hole 15 in the position shown in FIG. 1.

In order to clamp and cut off the thread 10, the drive piston-and-cylinder unit 34 is actuated, so that the lever 3 is swivelled into its position 31' through a sudden movement of the piston rod 33. Thereby, the operating bar 26 is raised upwards and the operating slider 18 with its two plates 19 and 20 is also displaced upwards, the extension 12 of the guide part 11 dipping more deeply into the recess 21.

Accordingly, the thread 10,which is to be cut, comes to rest against the movable thread cutting edge 25 of the bore 23 of the front plate 19 and is then cut off, as soon as the thread is positioned opposite to the upper cutting edge 42 of the fixed counter blade 39. It is important that in the upward feed movement of the operating slider 18 in the direction of the arrow 4, the thread already lies in the clamping gap 17 and is severed there whilst it is clamped. The thread is thus cut in a guided manner and is held whilst it is being cut.

After the thread has been severed, however, the operating slider 18 rises further in the direction of the arrow 4, whereby the severed thread end arrives in the upper part of the elongate hole 24 of the keyhole-shaped recess 22 but still remains in the clamping gap 17.

The thread is, therefore, reliably clamped and can no longer be released from the clamping gap 17 on downward return movement of the operating slider 18 in the direction of the arrow 4. This affords an essential advantage over the prior art discussed above in which the movable cutting blade (corresponding to that of the front plate 19), also provides a clamping face for the severed thread, so that upon withdrawal of the cutting blade, said clamping face is removed and the thread is freed.

In the case of the present invention, even upon withdrawal of the front plate 19, the thread remains in the clamping gap 17 and is accordingly secured.

The severed thread can only be drawn from the gap 17 when the embroidery site is put into operation again. The severed thread is bound with the front thread so that there is sufficient pull on the severed rear or lower thread to draw the severed thread out of the clamping gap 17.

The rail 35 has angular bends previously designated as lever 31, these bends serving to actuate the respective extension 8 for the respective operating bar 26.

The entire operating slider 18 should be guided in the guide part 11 so as to be concealed and closed in from all sides, the guide part 11, in turn, being held in the shuttle plate in the stitch plate 2 and in the intermediate plate 37. The thread clamping device 16 is thereby protected against soiling.

The entire operating slider 18 with its operating bar 26 is integrated in the stitch plate 2 or respectively in the intermediate plate 37, which is connected with the stitch plate 2. A compact construction which is economical of space being thereby achieved, in particular because the moving parts all move in the plane of the stitch plate 2.

The embroidering machine can be switched off at stitch sites. When the stitch sites are disconnected on the needle side or when the needles are stopped manually, the shuttles need not be stopped in order to prevent friction of the rear or lower thread.

On the shuttle side all of the shuttle threads are first clamped and then severed. The severed shuttle threads are then further conveyed into the clamping gap 17, so that on a renewed upward movement of the cutting device they cannot be severed again by the cutting device and, above all, cannot be released. Thereby, the rear or lower thread is clearly fixed in the stitch plate in the region of the stitch hole 15, and despite oscillating movement of the shuttle 3 cannot be rubbed. The fixing of the rear or lower thread in the region of the thread hole, therefore, prevents rubbing of the rear or lower thread, even when the shuttle 3, oscillates in the directions of the arrow 4.

In summary, it may be said that a thread clamping and cutting device is provided in the region of the stitch hole in which device a clamping gap 17 of a thread clamping device 16 is arranged, in extension of the cutting direction of the cutting blade, so that the thread which was previously clamped by the cutting device and subsequently cut, is then engaged and fixed in the clamping gap 17 which lies behind in the cutting direction.

Since the thread clamping and cutting device is provided in the immediate region of the stitch hole 15, the part of the rear or lower thread, which remains on the material, is severed so as to be extraordinarily short.

The cutting device first conveys the thread, which is to be severed, without severing, it in the clamping gap 17 and then severs the thread only there. When the thread has been severed, the rear or lower thread in the clamping gap 17 is conveyed further upward, in order finally to fix this thread.

As will be appreciated from the foregoing the cutting device is guided so as to be slidable in the plastics guide part 11 consisting substantially of the front plate 19 and of a rear plate 20.

FIG. 2 shows the shuttle guides 6, **6*a* and 6*b*, the central part of FIG. 2 showing all the parts of a finished shuttle guide 6*a*** with the thread clamping and cutting device integrated therein.

The right hand part of FIG. 2 shows the thread clamping and cutting device with the front wall of the shuttle guide 6 removed, and the left hand part of FIG.

2 shows the clamping device with the operating slider 18 removed.

By virtue of the aligned opposed arrangement of the keyhole shaped recesses 22 over the clamping gap 17, the guidance of the thread into the clamping gap 17 is improved. It is only important, however, that the clamping gap 17 is sufficiently long with respect to the keyhole shaped recess 22 of the front plate 19 to enable the thread to be clamped and severed in the front region of the clamping gap 17 and then further transported rearwardly into the clamping gap 17 by the cutting device.

The elongate hole 24 of the keyhole shaped recess 22 in the front plate 19 serves to enable the severed thread 10 to be pushed out of the clamping gap 17 when the operating slider 18 runs back.

The elongate hole 24 of the recess 22 in the rear plate 20 also serves the same purpose.

The term "rear or lower thread" is used herein as a synonym for a "rear or lower thread".

The term "rear or lower thread", however is used herein only in relation to the operating process and the devices described herein, in respect of an embroidering machine having a shuttle.

The more general term "rear or lower thread", therefore, relates not only to embroidering machines with corresponding shuttle and associated shuttle threads, but also to other embroidery means such as, for example, double chain embroidering machines and embroidering machines with round grippers.

What is claimed is:

1. A device for clamping and cutting a rear or lower thread in an embroidery machine comprising a stitch plate having a stitch hole, a shuttle guide and a shuttle displaceably mounted in the shuttle guide, the clamping and cutting device comprising a device for clamping said thread and a device for cutting said thread, said clamping and cutting device being located in the region of the stitch hole, the cutting device comprising a cutting blade having a cutting edge for cutting said thread in a cutting direction, the clamping device comprising a clamping gap for clamping the thread located downstream of the cutting blade in the cutting direction, the clamping gap being oriented perpendicular to the cutting blade of the cutting device, whereby the thread is moved into the clamping gap by means of the cutting device and subsequently cut by said cutting device.

2. A device for clamping and cutting a rear or lower thread in an embroidery machine comprising a stitch plate having a stitch hole, a shuttle guide and a shuttle displaceably mounted in the shuttle guide, the clamping and cutting device comprising a device for clamping said thread and a device for cutting said thread, said clamping and cutting device being located in the region of the stitch hole, the cutting device comprising a cutting blade having a cutting edge for cutting said thread in a cutting direction, the clamping device comprising a clamping gap for clamping the thread located downstream of the cutting blade in the cutting direction, the clamping gap being oriented perpendicular to the cutting blade of the cutting device, whereby the thread is moved into the clamping gap by means of the cutting device and subsequently cut by said cutting device, said clamping and cutting device further comprising an additional operating element said element being able to move simultaneously with the cutting device and being located on the opposite side of the clamping device conveying the rear or lower thread in cooperation with said cutting device into the clamping gap of the clamping device, said clamping gap clamping the thread independently of the position of the cutting device and the additional operating element.

3. A device as claimed in claim 2, comprising a guide part for slidably guiding the cutting device therein, the cutting device and the additional operating element consisting essentially of two plates, located one on each side of the clamping device.

4. A device as claimed in claim 3, each of the plates being furnished with keyhole-shaped holes and the hole in the plate forming the cutting device having a cutting edge.

5. A device as claimed in claim 4, wherein the severed thread is released from the clamping device by traction upon the initiation of a subsequent embroidering operation.

6. A device as claimed in claim 1, wherein the cutting blade moves in the plane of the stitch plate.

7. A device as claimed in claim 1, wherein the clamping device is located in the immediate vicinity of the cutting device, the apparatus being in approximate alignment opposite to the stitch hole in the stitch plate.

8. A device as claimed in claim 1, wherein the entire cutting and clamping device is integrated into the stitch plate.

9. A device as claimed in claim 1, wherein the cutting blade is movable whereas the clamping device and a counter blade for co-operation with the cutting blade are both fixed.

10. A device as claimed in claim 1, comprising a guide part to which the cutting device and the clamping device are attached, allowing the device to be replaced.

11. A method for operating an embroidery machine with a thread clamping device and a cutting device for a rear or lower thread, comprising, in sequence:

cutting the rear or lower thread;

feeding the cut thread from the cutting device into the clamping device; and clamping the cut thread independently of the cutting step;

releasing the cut thread from the clamping device by traction upon initiation of a subsequent embroidering operation.

12. A method for operating an embroidery machine with a thread clamping and cutting device for a rear or lower thread comprising, in sequence:

supplying a cut rear or lower thread from the cutting device to the clamping device; and clamping the cut thread in the clamping device independently of operation of the cutting device; and releasing the cut thread from the clamping device by traction upon initiation of a subsequent embroidering operation.

* * * * *